United States Patent [19]

McKenzie, III

[11] 4,048,770

[45] Sept. 20, 1977

[54] BUILDING STRUCTURE

[76] Inventor: Alexander J. McKenzie, III, Box 704, Wolfeboro, N.H. 03894

[21] Appl. No.: 657,165

[22] Filed: Feb. 11, 1976

[51] Int. Cl.[2] ..... E04B 1/32

[52] U.S. Cl. ..... 52/81; 52/82; 52/DIG. 10

[58] Field of Search ..... 52/80, 81, 82, 237, 52/DIG. 10, 79.4

[56] References Cited

U.S. PATENT DOCUMENTS

| | | | |
|---|---|---|---|
| 1,678,435 | 7/1928 | Hannerbeck | 52/664 |
| 3,114,176 | 12/1963 | Miller | 52/81 |
| 3,445,970 | 5/1969 | Nelson | 52/81 |
| 3,530,621 | 9/1970 | Ratzebeck | 52/81 |

FOREIGN PATENT DOCUMENTS

| | | | |
|---|---|---|---|
| 1,331,238 | 5/1963 | France | 52/81 |
| 368,611 | 5/1963 | Switzerland | 52/236.1 |

OTHER PUBLICATIONS

Dome Book II, © 1971, pp. 14, 15, 16, 17, 19, 22, 23, 45, 98 and 99.

*Primary Examiner*—Price C. Faw, Jr.
*Assistant Examiner*—Henry Raduazo
*Attorney, Agent, or Firm*—C. Yardley Chittick

[57] ABSTRACT

A plurality of identical panels shaped as equilateral triangles with peripheral framing whereby the panels are adapted to be bolted together to form a space enclosing structure whose outer surface will be 15/20th of an icosahedron. The five roof panels have extensions on one side to form overhangs.

7 Claims, 14 Drawing Figures

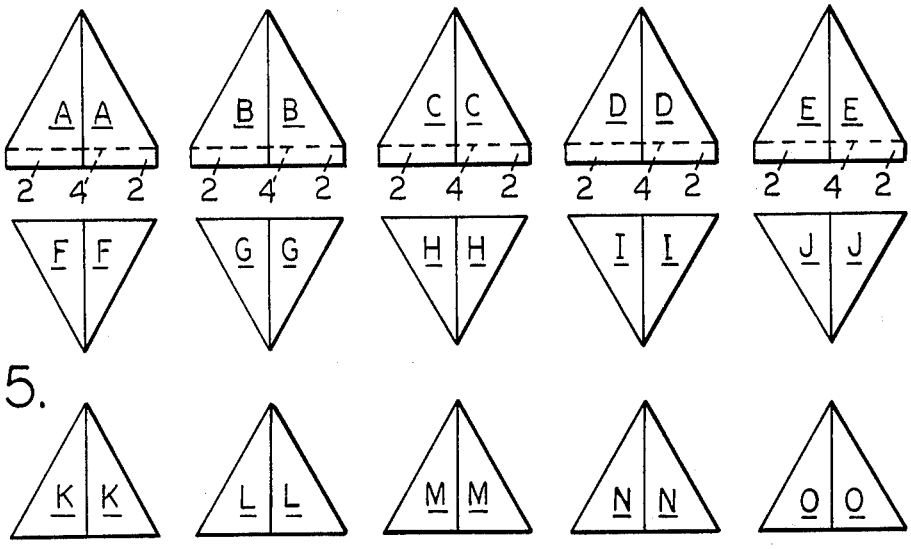
FIG. 5.
FIG. 6.
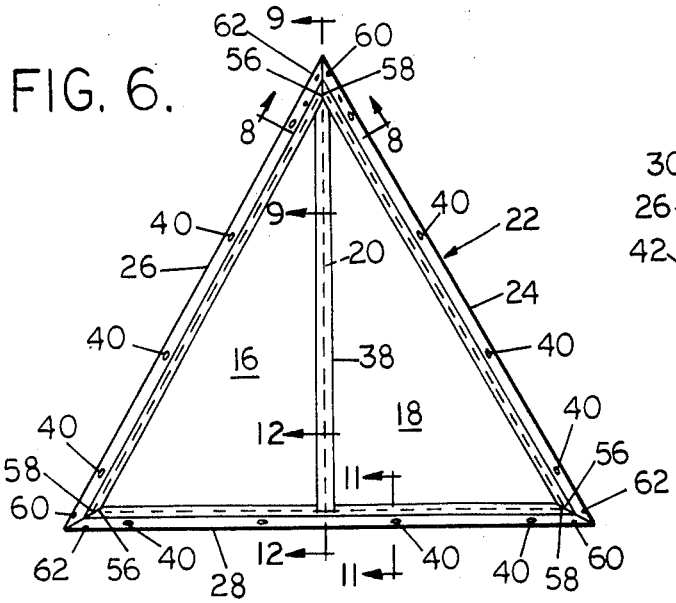
FIG. 8.
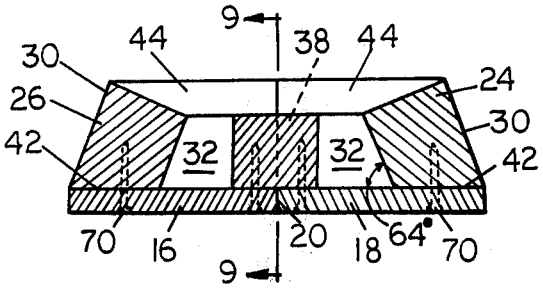
FIG. 7.
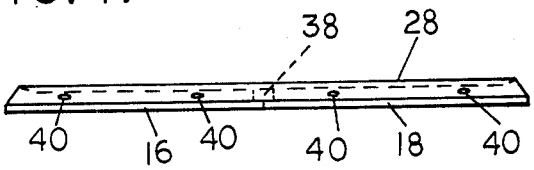
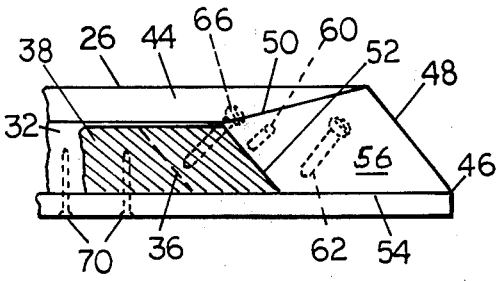
FIG. 9.

FIG. 10.
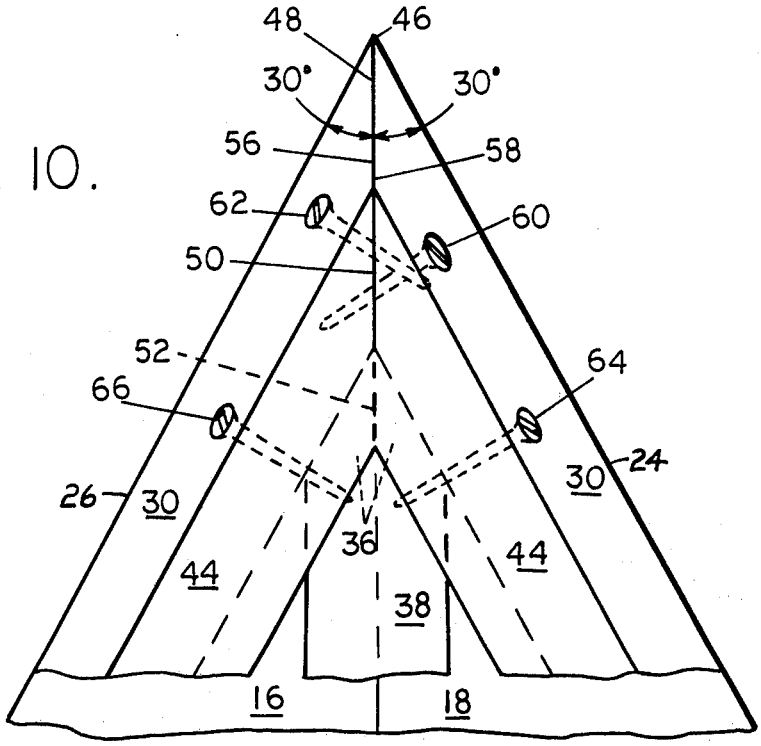
FIG. 11.
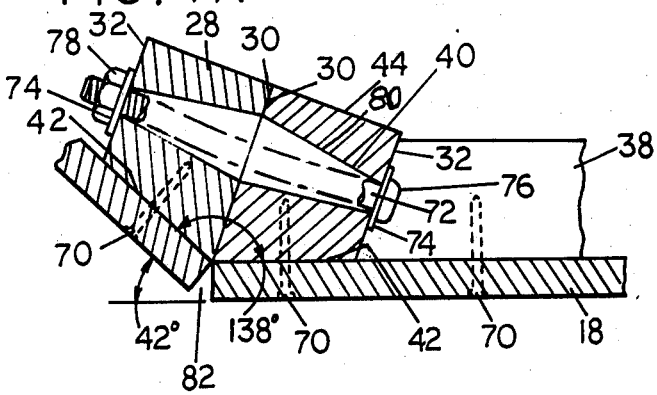
FIG. 13.
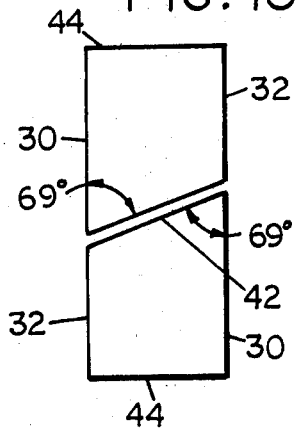
FIG. 12.
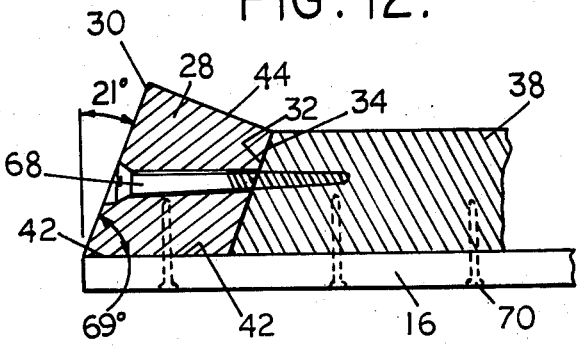
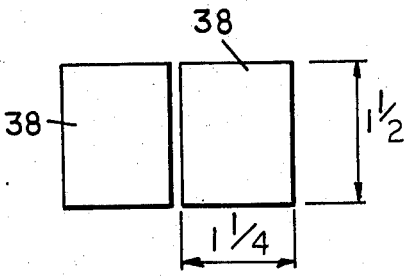
FIG. 14.

BUILDING STRUCTURE

BACKGROUND OF THE INVENTION

Space enclosing structures made of panels in the form of equilateral triangles assembled to form a major portion of an icosahedron have been made heretofore. See the U.S. Pat. to Wilson, No. 3,660,952. A structure in the form of an icosadhedron in which each side is shaped as an equilateral triangle, gives a relatively high volume of enclosed space in relation to the outside area.

According to the prior art relating to icosahedron type buildings, it is customary to omit the bottom five triangles of the icosahedron thereby providing a stable structure with relatively large floor area which has a wall in the form of 10 connected triangular panels forming a five sided base and a roof of five triangular panels mounted on the top of the wall. When all of the panels have been affixed to each other and the bottoms of the walls have been secured to a level base or flooring, there is formed a 15 sided structure of extreme rigidity and strength capable of withstanding with ease, all kinds of weather conditions. Entry into such structure is obtained by cutting a doorway through one of the panels and if desired mounting therein a door or other suitable closure such as a curtain, screen or removable panel.

SUMMARY OF THE INVENTION

While the structural configuration of the present invention is old, the novelty resides in the manner in which the triangular panels are constructed and the peripheral framing used therewith. This is accomplished through the use of conventional, inexpensive materials which need only be saw-cut to predetermined patterns and then glued, screwed and nailed together to form each individual panel and its peripheral frame. The individual panels in turn are connected through the use of carriage bolts placed in aligned holes in the supporting edge frames. When all of the panels are connected and in proper alignment, the bolts are tightened drawing the frames tightly together to create weather tight joints.

Each equilateral panel is made of two triangular pieces of plywood of which two such triangular pieces are obtained from a single conventional 4 foot by 8 foot sheet of plywood. The five panels forming the roofing portions of the structure will include overhangs which serve as further insurance against the entry of rain through the joints between the roof and wall panels. The framing around the edge of each panel is made from conventional lumber preferably so-called 2×4's which are sawed length-wise at a predetermined angle. Intermediate nailing strips are formed from 2×3's which are sawed in half lengthwise.

A finished housing unit, having an approximate diameter of 12 feet may be constructed from 15 sheets of 4×8 foot plywood of any selected thickness, and preferably that known in the trade as A C exterior plywood or equivalent, 180 feet of 2×4's, 53 feet of 2×3's, a gross of screws, 80 carriage bolts, 5 pounds of nails, and sufficient water-proof glue to cover about 50 square feet. The tool requirements are minimal, a saw, drills of two sizes, a reamer, a screw driver, a hammer, and a wrench.

After the 15 panels have been made, one with a doorway cut therethrough, the structure can be erected by two men in less than 2 hours. The completed building may be caulked at the joints if desired, and the exterior and interior finished to taste and as needed according to the climatic conditions prevailing.

BRIEF DESCRIPTION OF THE DRAWINGS

FIG. 5 illustrates the manner in which the sections cut as in FIG. 4 are combined to produce the five roof panels and the 10 wall panels.

FIG. 6 is a plan view of the supporting frame and intermediate nailing strip with two abutting sections of panels mounted therebehind.

FIG. 7 is a front elevation of FIG. 6.

FIG. 8 is an enlarged section taken on the line 8—8 of FIG. 6.

FIG. 9 is an enlarged section taken on the line 9—9 of FIG. 6.

FIG. 10 is an enlarged plan view of the upper apex of FIG. 6.

FIG. 11 is an enlarged section taken on the line 11—11 of FIG. 6 to which has been added the abutting frame of the next adjacent panel showing the aligned bolt holes and bolt therein.

FIG. 12 is an enlarged section taken on the line 12—12 of FIG. 6.

FIG. 13 is an end elevation of a length of 2×4 sawed lengthwise at a particular angle to create two pieces from which the frame is fabricated.

FIG. 14 is an end view of a length of 2×3's sawed lengthwise to provide nailing strips to which the abutting edges of the panel sections are nailed.

DESCRIPTION OF A PREFERRED EMBODIMENT

Figure 1:
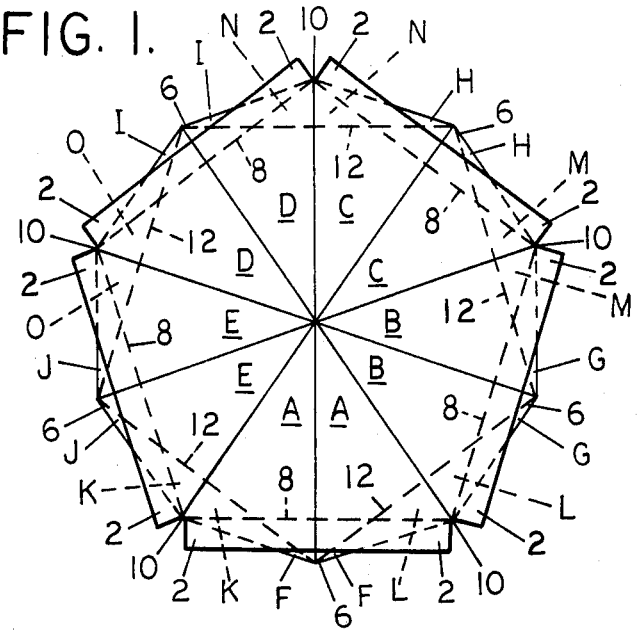
FIG. 1 is a plan view of a building structure made through the use of my panels. Overhangs extend from the roof panels.
Figure 2:
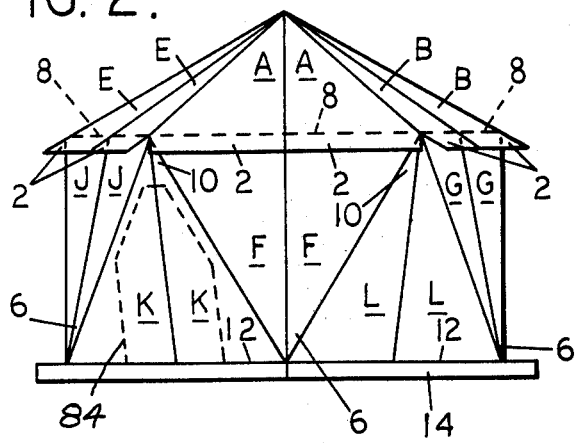
FIG. 2 is a side elevation of FIG. 1, showing also the overhangs of the roof panels.
Figure 3:
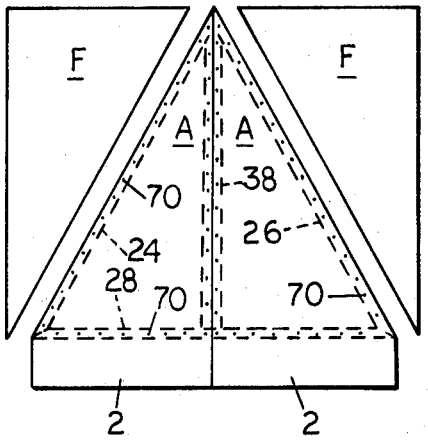
FIG. 3 is a plan view of a roof panel, including the overhangs. The two remaining triangular portions cut from two rectangular plywood sheets are combined to produce a second panel without overhang.

The type of building which may be constructed through the use of my panels is shown in FIGS. 1 and 2. The form is the well understood icosahedron type in which there are 10 wall panels and five roof panels. The bottom five panels of the icosahedron are omitted so the wall panels may rest directly on any level surface forming a floor.

As will be understood from an inspection of FIGS. 1,2,3,4 and 5, each panel is constructed from two identical but reversed cut pieces of plywood each cut from a rectangular sheet in the form of a right triangle in which the base is one-half of the hypotenuse. The pieces are rearranged with their altitudes abutting and secured by means of a peripheral frame and an intermediate nailing strip hereinafter described.

Figure 4:
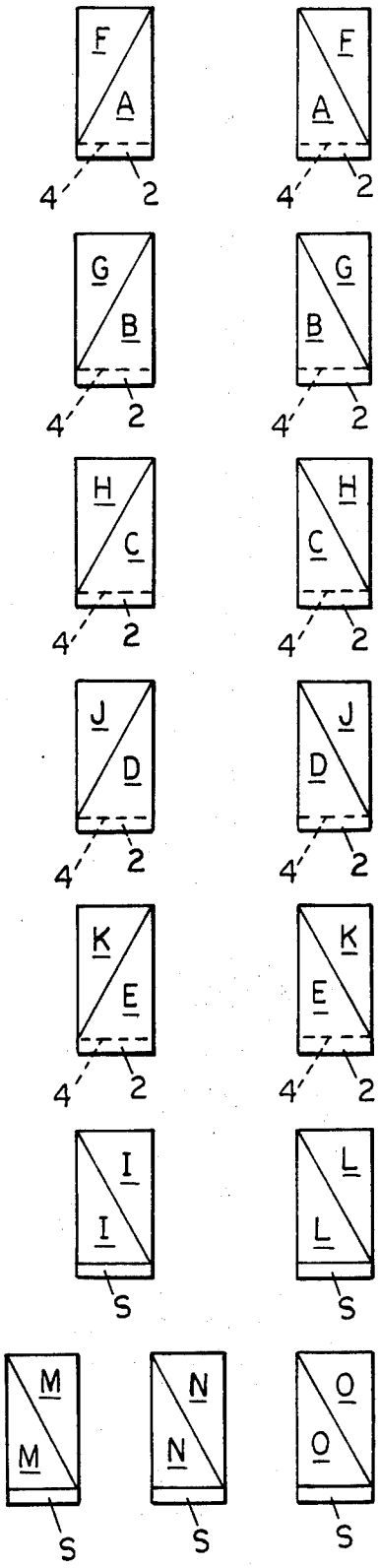
FIG. 4 shows 15 sheets of plywood measuring 4 × 8 feet and the manner in which they are cut to produce five roof panels with overhangs and 10 wall panels.

The lettering on the 15 plywood sheets illustrated in FIGS. 4 and 5 shows how the sheets were first cut and then assembled to form identically framed equilateral triangular panels. The panels AA, BB, CC, DD and EE all include extensions 2 which are the parts below the dotted lines 4. These extensions have a length of 1.07 feet and are 4 feet wide, the width of the plywood sheet. The extensions 2 are hereinafter referred to as the overhangs as they overhang the wall of the building as can be seen in FIGS. 1 and 2.

The only unused portions from the 15 plywood sheets are those end parts marked S in FIG. 4 on sections L, M, N, O and I. These scrap parts total only 22 square feet out of a total plywood area of 480 square feet.

Referring again to FIGS. 1 and 2, the roof panels are AA, BB, CC, DD and EE. The wall panels FF, GG, HH, II, and JJ have their apexes 6 down and their bases 8 up and lying in a common horizontal plane. The bases of the roof panels rest on the aforementioned five edges 8.

Wall panels KK, LL, MM, NN, and OO have their apexes 10 up and their bases 12 down. The bases 12 rest on a floor 14 or equivalent horizontal surface.

The wall panels are not vertical. Each slopes slightly outwardly in the direction of its apex.

A major feature of the invention lies in the construction of the peripheral frame of each panel, whereby each roof panel can be bolted to two adjacent roof panels and to one adjacent wall panel and whereby each wall panel can be bolted to two adjacent wall panels and alternately to a roof panel and to the flooring. The panel frame construction gives rigidity to each panel and the 15 panels when assembled and bolted together produce a completed structure of great strength capable of withstanding all wind, rain and snow loads.

Referring now to FIG. 6, which is an interior view of a wall panel, the abutting plywood sections are indicated at 16 and 18 with the line of abutment at 20. The panel is 8 feet on a side. Along the periphery is a frame generally indicated at 22 which is comprised of three 8 foot long braces 24, 26 and 28. These braces are constructed in a particular manner whereby they may be joined securely at their apexes and also be positively attached to the edge areas of the panels. As can be seen in FIGS. 8, 11 and 12 the braces are trapezoidal in cross section and are constructed so that both the outer side 30 and the inner side 32 slope inwardly at an angle of approximately 69° whereby the outer side 30 will abut flush against the corresponding outer side of the frame of the next panel (see FIG. 11) to make a tight connection and whereby the inner side 32 will provide an undercut arrangement to receive and retain the sloping ends 34 and 36 of a nailing strip 38. The anlge of 69° for the outer sides 30 of the braces is the essential angle permitting the outer sides of the braces of adjacent panels to abut each other in an assembled icosahedron type structure.

Each brace 24, 26 and 28 has a plurality of holes 40 drilled therethrough at right angles to the sides 30 and 32. These holes are accurately spaced along the length of each brace so they will be in accurate alignment with the corresponding holes in the adjacent brace of the frame of the next panel. A preferred arrangement is shown in FIGS. 6 and 7 in which there are four holes 40 in each brace. The end holes are 1 foot in from the end and the four holes are spaced 2 feet apart.

The trapezodial cross-sectional form of the braces is provided as shown in FIG. 13 by cutting a length of 2×4 longitudinally without waste into two equal parts with the cut at approximately 69°. This provides a base side 42 (see FIG. 8) which rests on the panel, outer and inner sides 30 and 32 at 69° to the panel and a top side 44 at right angles to sides 30 and 32.

A length of finished 2×4 when cut in half lengthwise provides a brace having approximate cross-section dimensions of: base 1 9/16 inches, outer side 2 inches, inner side 1⅜ inches and top side 1 7/16 inches.

Each brace extends the full length, 8 feet, of each side of the panel. The ends are mitered so that the ends of adjacent braces may be glued and screwed together. To accomplish this result the braces are first cut to 8 foot lengths. Then with the brace resting on its base side, it is cut at a 30° angle to the long axis with the cut perpendicular to the base side and passing through the end corner 46 of the outer side 30 and the base side 42. See FIGS. 8, 9 and 10.

The shape of the cut thus made on brace 26 is a trapezoid and is shown in FIG. 9. The cut intersects with the outer side 30 along edge 48, with top side 44 along edge 50, with inner side 32 along edge 52 and with base side 42 along edge 54. This trapezoidal surface marked 56 in FIG. 9 will engage flush against a corresponding complementary trapezoidal surface 58 on the end of brace 24.

Identical surfaces 56 and 58 will be cut on the other ends of braces 24, 26 and 28 so that the three braces can be brought together to form an equilateral frame 8 feet on a side. Glue is applied to faces 56 and 58 and then screws 60 and 62 are inserted to make three permanent, rigid joints.

With the frame 22 now completed, it is placed upside down on a level supporting surface so that the base sides 42 are now on top and lying in a common plane.

The nailing strip 38 is then dropped in place. The end that engages the frame apex is cut as at 36 to provide two sloping surfaces that will abut inner sides 32 of braces 24 and 26. See FIGS. 8, 9 and 10. The parts are permanently secured by screws 64 and 66.

The other end of nailing strip 38 is bevelled as at 34 to fit tightly against the undercut inner side 32 of brace 28 at its mid point. See FIG. 12. A screw 68 permanently secures strip 38 in place. The assembly of the frame 22 and nailing strip is now complete.

It should be mentioned that the dimensions of the nailing strip in section should be about 1¼ × 1½ inches. A conventional length of finished 2 × 3 when cut in half will produce a strip of these dimensions. See FIG. 14.

Glue is applied to base surfaces 42 of braces 24, 26 and 28 and to the upper face of the nailing strip. The two right triangle panel parts 16 and 18 are then accurately positioned on the frame with their peripheries coinciding and with their line of abutment 20 extending along the center line of nailing strip 38.

The glued parts are clamped together while an adequate number of nails 70 are driven through the plywood panels into the frame and the nailing strip to render all parts permanently attached to each other.

FIG. 11 illustrates the manner in which one panel is connected along one side to the adjacent side of the next panel. The dimensions of the abutting braces are such that a 3½ inches carriage bolt 72 is needed to extend therethrough. Washers 74 are placed under the bolt head 76 and nut 78.

If the holes 40 through braces 28 were straight cylinders, the clearances are such that a 3½ inches bolt could not be inserted. Therefore I have found it expedient at the time of drilling holes 40, to use a conical reamer to enlarge the interior portion as indicated at 80. Then by placing a small bend in the shank of bolt 72, the bolt may be readily inserted and thereafter tightened without in any way diminishing its effectiveness.

The joints between panels, one of which is shown at 82 in FIG. 11 may be caulked as an added precaution against the weather. A door as suggested at 84 in FIG. 2 may be cut through one of the wall panels prior to assembly.

Braces 28 of wall panels KK, LL, MM, NN and OO which rest on the floor 14 may be secured thereto by suitable screws inserted instead of bolts.

In summary it will be seen that a useable inexpensive small building of great strength may be fabricated from plywood panels cut from 15 conventional 4 × 8 foot plywood sheets in a novel manner producing less than 5% waste. The two piece triangular panels are supported by a novel simplified one piece triangular frame the sides of which are adapted to be connected by bolts directly to corresponding sides of adjacent cooperating identical panels.

It is my intention to cover all changes and modifications of the example of the invention herein chosen for purposes of disclosure which do not constitute departures from the spirit and scope of the invention.

I claim:

1. A panel for use with other identical panels in erecting a space enclosing structure in the form of a partial icosahedron, said panel comprised of six elements, said elements being two sheets of plywood each in the form of a right triangle whose hypotenuse is equal to twice the base and positioned to abut along their altitudes to form a two part equilateral triangular panel, an equilateral triangular frame for supporting said panel, said frame comprising three identical elongated braces, each brace being the length of said hypotenuse and shaped as follows: each brace is four sided in cross section with a first side adapted to rest on an edge area of said panel, second and third parallel sides extending inwardly of said panel and away from the edges of said first side at an angle of approximately 69° and a fourth side at right angles to said parallel sides and at an angle to said first side of approximately 21°, each brace cut at both ends at 30° to the long axis and at right angles to said first side to form two faces each trapezoidal in shape, the six faces of said three braces being placed in face to face abutting pairs, and connected together to form a rigid equilateral triangular frame with said first sides lying in a common plane, said frame mounted on said panel with said first sides in engagement with the edge areas of said panel and the said three pairs of abutting faces bisecting the three apexes of said panel, said frame being securely affixed to said panel, and a single nailing strip rectangular in cross section and overlapping and abutting altitude edges of said sheets, said nailing strip cut at one end to form two diverging equal sized parallelograms whose bottom and top edges are at 60° to each other and at 30° to the longitudinal axis of said strip, and the faces of said parallelograms are at 69° to the bottom of said strip, said faces abutting the inner sides of said braces immediately adjacent the inner edges of that pair of abutting trapezoidal faces that are aligned with said abutting altitude edges of said sheets, said nailing strip extending along said abutting edges to a position at which its other end, which is cut crosswise at 69° to its bottom, is in engagement with the inner side of the opposite brace at its mid-point, and the abutting edges of said sheets being securely affixed to said nailing strip.

2. The construction set forth in claim 1, each said brace of said frame having a plurality of bolt holes therethrough according to a predetermined pattern whereby said bolt holes will align with corresponding bolt holes in an adjacent panel positioned for assembly therewith.

3. A building unit for use in the construction of an icosahedron type of building in which five units form the roof and 10 units form the wall, said unit comprised of six elements, said elements being an equilateral triangular frame comprised of three identical braces having 30° mitered ends fastened together, said braces having identical sides lying in a common plane and having outer and inner sides sloping inwardly at an angle of approximately 69°, a nailing strip bisecting said frame and extending from one apex of the frame to the mid-point of the opposite brace and having a side lying in said common plane, said nailing strip having diverging faces at one end which abut the said inner sides adjacent said mitered ends and having a transverse face at the other end which abuts the inner side of said opposite brace, and two plywood sheets, each sheet being in the form of a right triangle with its base equal to one-half its hypotenuse and with its hypotenuse equal to the length of said braces, said sheets arranged with their altitudes abutting to form an equilateral triangular panel whose edges coincide with the edges of said braces and whose abutting altitudes are covered by said nailing strip, the peripheral edge areas of said panel secured to the said identical sides of said braces and the edge areas along said altitudes secured to said nailing strip.

4. The construction set forth in claim 3, each said right triangular sheet having an integral rectangular portion extending beyond said base, the dimensions of said extending portion being the length of said base and the difference in length between said hypotenuse and altitude, said extending portion acting as an overhang when said unit is used as one of the five roof units of said iscosahedron type building.

5. A building unit comprising two pieces of plywood each cut in the form of a right triangle and placed in reversed abutting positions to form a panel with their peripheries forming an equilateral triangle, a triangular frame comprised of three identical braces each trapezoidal in cross section and having interior angles of 69°, 21°, 90° and 90°, said braces having mitered ends for abutting engagement with the mitered ends of the other braces, said frame being of the same peripheral dimensions as said panel and secured to the edge areas of said panel and an intermediate strip attached at its ends to said frame and extending from one apex of said frame to the mid point of the opposite brace of said frame and overlapping and secured to the edge areas of said abutting pieces, the outer surface of each said brace sloping inwardly at an angle of approximately 69° to the plane of said panel.

6. The construction set forth in claim 5, said frame having an under cut area at said one apex and an under cut area at the said opposite mid-point, the ends of said strip located in and connected to said undercut areas of said frame.

7. The method of making 15 units in the form of equilateral triangles to be used in constructing an icosahedron type building having five roof units and 10 wall units, said method comprising the steps of cutting each of fifteen 4 by 8 foot plywood sheets diagonally to form two pieces of which a first piece is shaped as a right triangle with a 4 foot base and an 8 foot hypotenuse, and a second piece is shaped in the form of a quadrilateral including two 8 foot sides, sawing away a rectangular end portion from five of said 15 second pieces to form five additional pieces shaped as right triangles the same as said first pieces, thereby to provide 20 first pieces and 10 second pieces, assembling said 20 first pieces in pairs to provide 10 equilateral triangular wall panels with 8 foot sides, assembling said ten second pieces in pairs to provide five equilateral triangular roof panels with 8 foot sides and with extensions from one side, and then securing all said pairs of pieces to equilateral triangular frames to form 15 completed units whereby said units can then be assembled to provide a circumferential wall of 10 units and a roof of five units with the said extensions overhanging said wall.

* * * * *